US008945817B2

(12) United States Patent
Tomizawa et al.

(10) Patent No.: US 8,945,817 B2
(45) Date of Patent: Feb. 3, 2015

(54) PROCESS FOR PRODUCING CHIP

(71) Applicant: Canon Kabushiki Kaisha, Tokyo (JP)

(72) Inventors: Keiji Tomizawa, Yokohama (JP); Chiaki Muraoka, Kawaguchi (JP); Takuma Kodoi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/146,203

(22) Filed: Jan. 2, 2014

(65) Prior Publication Data

US 2014/0198157 A1 Jul. 17, 2014

(30) Foreign Application Priority Data

Jan. 11, 2013 (JP) ..... 2013-003477

(51) Int. Cl.
*B41J 2/16* (2006.01)
*B41J 2/145* (2006.01)

(52) U.S. Cl.
CPC ..... *B41J 2/1631* (2013.01); *B41J 2/145* (2013.01)
USPC ..... 430/320

(58) Field of Classification Search
None
See application file for complete search history.

(56) References Cited

U.S. PATENT DOCUMENTS 7,070,912 B2 * 7/2006 Park et al. ..... 430/320
8,753,798 B2 * 6/2014 Ishizuka et al. ..... 430/320

FOREIGN PATENT DOCUMENTS

JP 2001-264637 A 9/2001
JP 2005-205916 A 8/2005

* cited by examiner

*Primary Examiner* — Lamson Nguyen
(74) *Attorney, Agent, or Firm* — Fitzpatrick, Cella, Harper & Scinto

(57) ABSTRACT

A process for producing a chip in which plural ejection orifice arrays are arranged including conducting reduction projection exposure plural times to a wafer having a substrate and a photosensitive resin layer formed thereon while relatively moving positions of the wafer and a reticle to form ejection orifice array patterns in the resin layer, developing the patterns to form ejection orifice arrays in the resin layer, and dividing the wafer to form plural chips in which the plural ejection orifice arrays are arranged. The exposure is conducted once to form in the resin layer a first ejection orifice array pattern corresponding to partial ejection orifice arrays in an arranging direction thereof in one chip, a second ejection orifice array pattern corresponding to all ejection orifice arrays in one chip and a third ejection orifice array pattern corresponding to partial ejection orifice arrays in an arranging direction thereof in one chip.

6 Claims, 13 Drawing Sheets

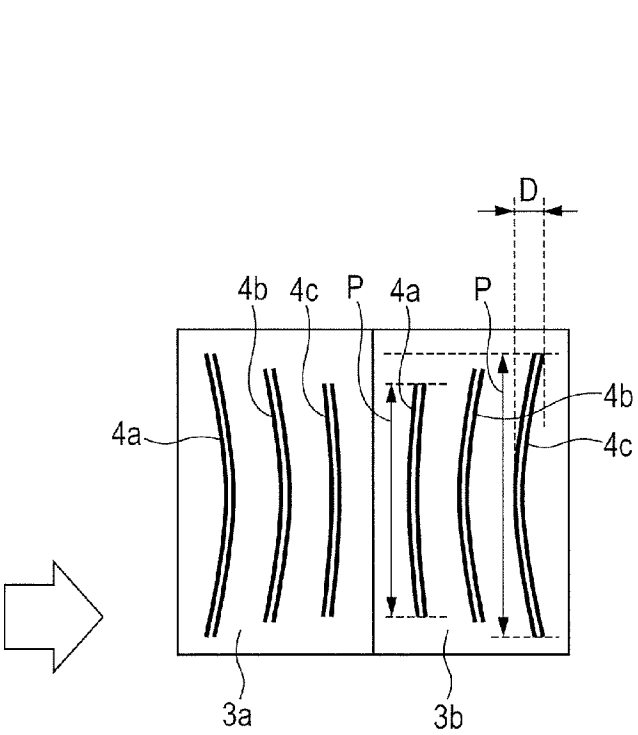
FIG. 3B
PRIOR ART
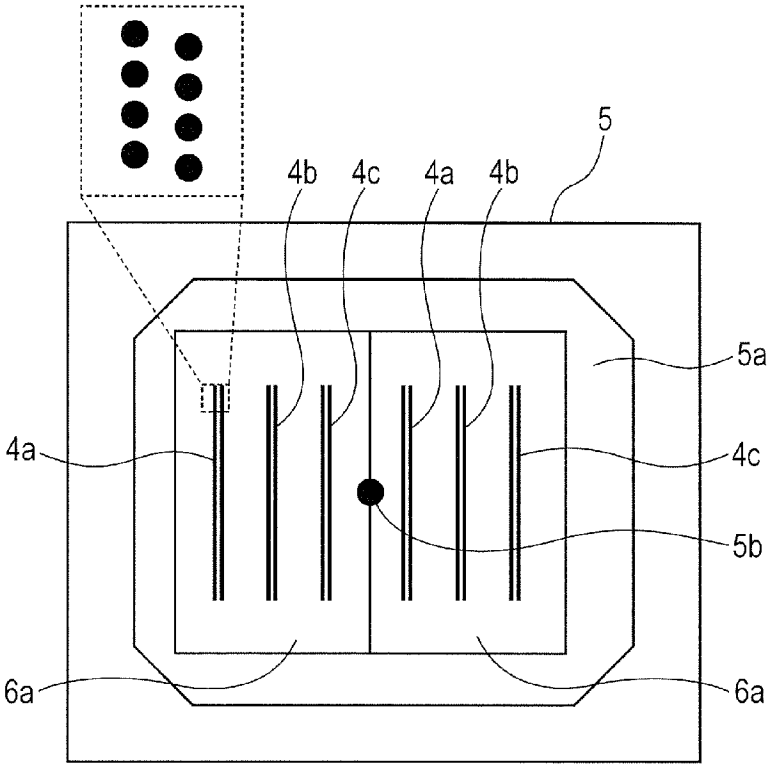
FIG. 3A
PRIOR ART
FIG. 3C
PRIOR ART

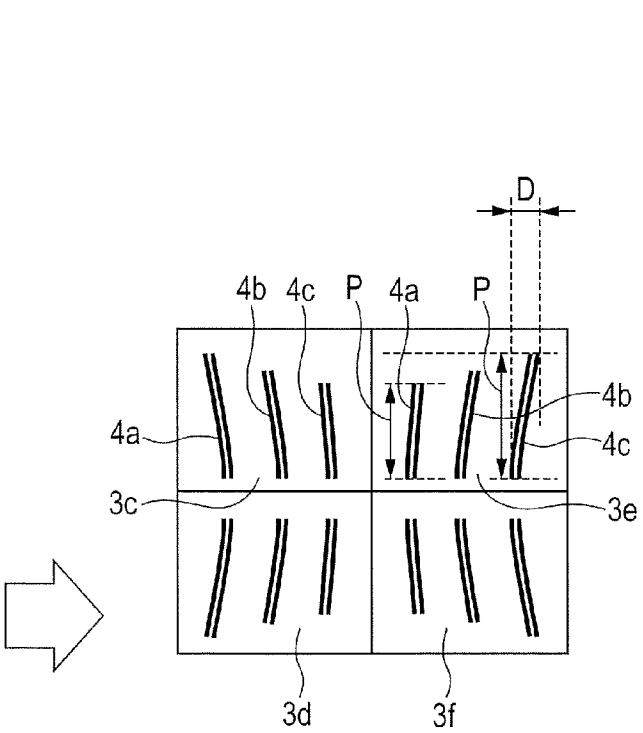
FIG. 4B
PRIOR ART
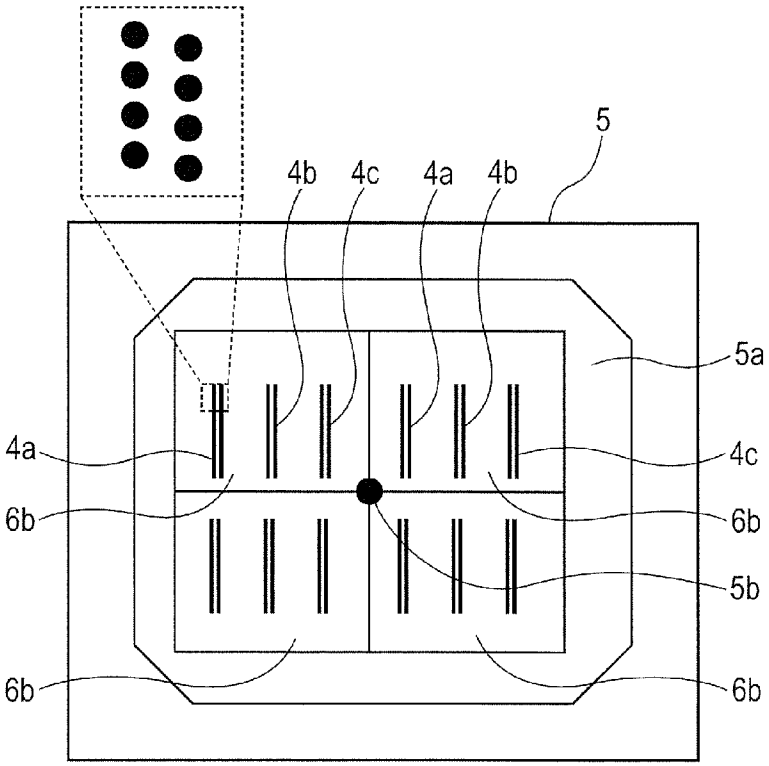
FIG. 4A
PRIOR ART
FIG. 4C
PRIOR ART

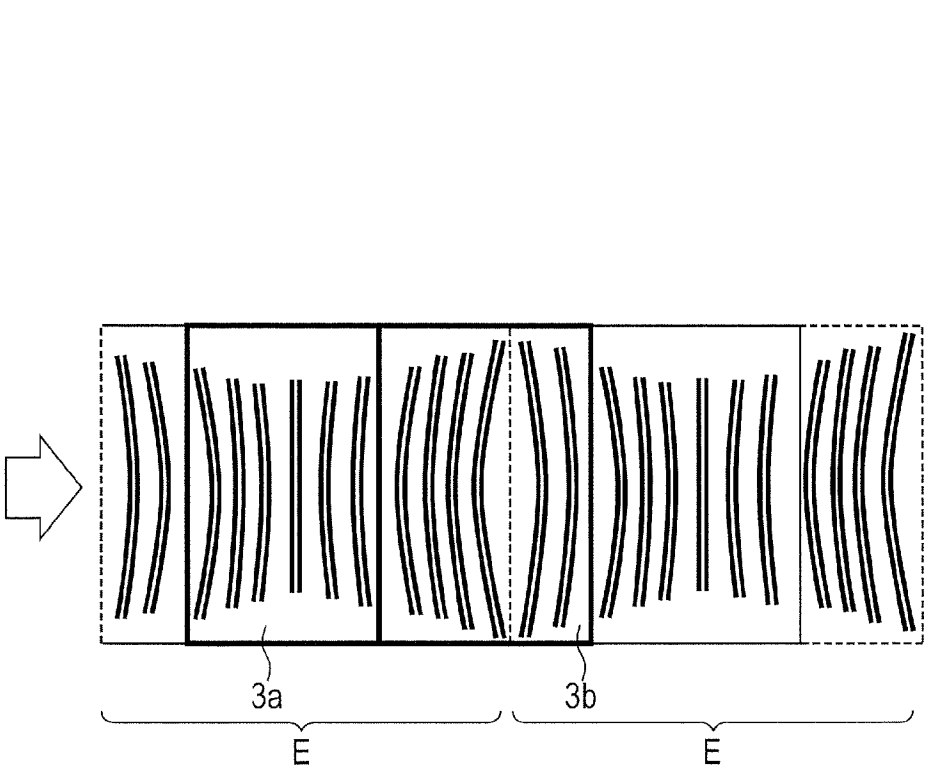
FIG. 12B
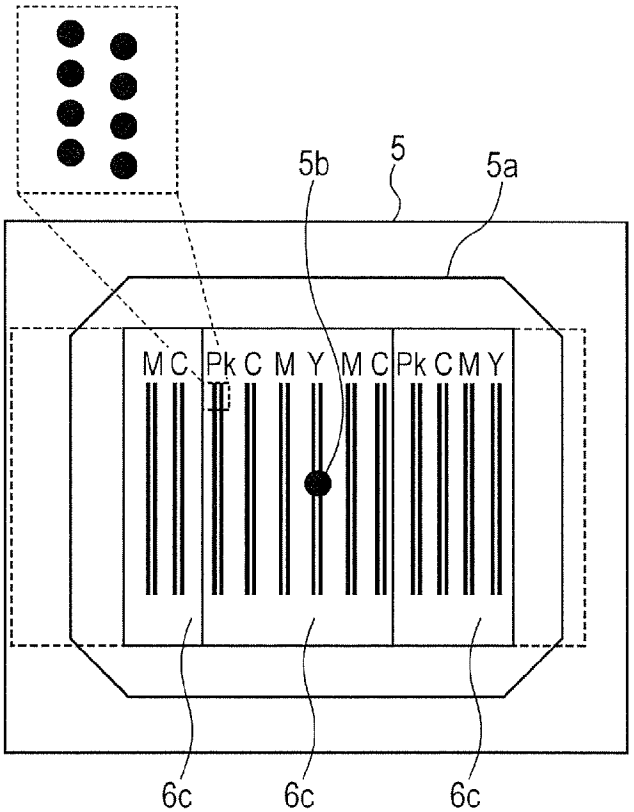
FIG. 12A
FIG. 12C 3a
4d
4e
4a
4b
4f
4c
7a
7b
7c
8c
8b
8a

PROCESS FOR PRODUCING CHIP

BACKGROUND OF THE INVENTION

1. Field of the Invention

The present invention relates to a process for producing a chip.

2. Description of the Related Art

As an example of a liquid ejection head from which a liquid is ejected, an ink jet recording head used in an ink jet recording system is mentioned. The ink jet recording head has a chip generally provided with a flow path, a heat-generating element provided in a part of the flow path for generating energy for ejecting an ink, and a minute ink ejection orifice for ejecting the ink. A process for producing such a chip includes the following steps:

a step of forming a pattern of a flow path with a photosensitive material on a substrate on which a heat-generating element has been formed and then applying and forming a coating resin layer which will become a flow path forming member with a photosensitive material on the substrate so as to coat the pattern; and a step of forming an ejection orifice in the coating resin layer obtained in the above step and then removing the photosensitive material used in the pattern to form the flow path.

According to this production process, minute processing as to the formation of the flow path and the ejection orifice becomes feasible with extremely high accuracy because a photolithographic method used in a semiconductor field is applied thereto. In this production process, patterning by exposure by means of a semiconductor exposure apparatus is used as a method for forming the photosensitive material into an intended shape upon the formation of the ejection orifice. When a negative photosensitive material is used, a shadow is prepared into a shape intended to be formed by, for example, a reticle, and exposure is conducted through the semiconductor exposure apparatus, whereby the photosensitive material of a portion where the shadow has been prepared and light has not been applied is not cured and removed in a removal step.

On the other hand, as a process for improving the productivity of a chip, a process in which a great number of liquid ejection heads are fabricated as chips on a wafer such as an Si wafer, and respective chips are divided by cutting to obtain individual liquid ejection heads is used. According to this process, the plural chips can be treated successively or at a time under the same conditions in the respective production steps, and so the efficiency of production can be improved. For example, when an intended structure is fabricated in the respective chips by exposure and development for the photosensitive material, exposure of the same exposure pattern can be successively conducted for the respective chips by means of a reticle of an exposure apparatus, whereby the exposure treatment can be conducted with good efficiency.

In recent years, the length of a chip has been made longer for achieving high-speed printing. In addition, the number of ejection orifice arrays (also referred to as nozzle arrays) taking charge of different colors is also increased with the increase in the kinds of inks for expanding a color gamut in photo-printing, and the breadth of the chip is also widened owing to the increase in the nozzle arrays corresponding to respective colors. As a result, an area per chip comes to increase. Under such circumstances, a pattern is arranged for use up to the neighborhood of the margin of a field angle of a reticle for the purpose of exposing plural chips at a time for shortening process time and reducing the number of times of exposure. As a result, when reduction projection exposure is conducted, light transmitted through a portion high in curvature of a lens in a projection lens system within a semiconductor exposure apparatus is influenced by lens aberrations to greatly affect the finish of ejection orifice formation in some cases. It means that when the light from the semiconductor exposure apparatus is adjusted so as to exactly form a pattern utilizing a part around a center of the reticle, exposure is conducted at a position of outside distortion with respect to an ideal lattice with increasing distance from the part around the center of the reticle. An example thereof is typically illustrated in FIGS. 1A and 1B. FIG. 1A illustrates ideal lattice patterns provided on the whole surface within the field angle of the reticle, and a solid-line portion becomes a light shielding portion. FIG. 1B illustrates that a pattern obtained in the case where the exposure is conducted by means of this reticle and formed of an actual light shielding portion on an object to be exposed has a portion distorted from the ideal lattice pattern. That is to say, when a pattern is formed in the neighborhood of the margin of a field angle of a reticle of a stepper exposure apparatus, and a chip is exposed to light having passed through that pattern to form an ejection orifice, there has been caused such a problem that the position of the ejection orifice deviates outside from the center of the reticle.

Regarding such an optical problem, Japanese Patent Application Laid-Open No. 2001-264637 (Patent Literature 1) discloses means for basically correcting the above-described aberrations by devising a lens system. According to this means, a spherical aberration-correcting optical system is installed in the inside and detachably mounted on the side of an image of an objective lens, and a lens group closest to the side of an object has negative refracting power and is moved in a direction of an optical axis, whereby the spherical aberration can be corrected.

SUMMARY OF THE INVENTION

According to the present invention, there is provided a process for producing a chip in which plural ejection orifice arrays are arranged, the process comprising the steps of conducting reduction projection exposure plural times to a wafer having a substrate and a photosensitive resin layer formed on the substrate while relatively moving positions of the wafer and a reticle to form ejection orifice array patterns in the photosensitive resin layer, developing the ejection orifice array patterns to form ejection orifice arrays in the photosensitive resin layer, and dividing the wafer having the photosensitive resin layer in which the ejection orifice arrays have been formed to form plural chips in which the plural ejection orifice arrays are arranged, wherein the reduction projection exposure is conducted once to in the photosensitive resin layer form a first ejection orifice array pattern corresponding to partial ejection orifice arrays in an arranging direction of ejection orifice arrays in one chip, a second ejection orifice array pattern corresponding to all ejection orifice arrays in another one chip and a third ejection orifice array pattern corresponding to partial ejection orifices array in an arranging direction of ejection orifice arrays in a further one chip.

Further features of the present invention will become apparent from the following description of exemplary embodiments with reference to the attached drawings.

BRIEF DESCRIPTION OF THE DRAWINGS

FIGS. 3A, 3B and 3C are explanatory views of another conventional embodiment and illustrate a reticle for exposing two chips adjoining each other of a chip array on a silicon wafer and the chips exposed by the reticle.

FIGS. 4A, 4B and 4C are explanatory views of a further conventional embodiment and illustrate a reticle for exposing four chips adjoining each other of two chip arrays arranged in parallel on a silicon wafer and the chips exposed by the reticle.

FIGS. 5A, 5B and 5C are explanatory views of a still further conventional embodiment and illustrate formation of dots upon printing using a chip exposed by a conventional reticle, in which FIG. 5A illustrates an arrangement state of ejection orifice arrays formed in the chip, FIG. 5B illustrates the state of dot filling per pixel, and FIG. 5C illustrates the state of dot filling per pixel after driving is corrected in a head-scanning direction.

FIGS. 12A, 12B and 12C are explanatory views of a third embodiment of the present invention and illustrate a reticle for exposing chips on a silicon wafer and the chips exposed by the reticle.

FIGS. 13A, 13B and 13C are explanatory views of the first embodiment and illustrate formation of dots upon printing using a chip exposed through a pattern located at the center of the reticle according to the first embodiment, in which FIG. 13A illustrates an arranged state of ejection orifice arrays formed in the chip, FIG. 13B illustrates the state of dot filling per pixel, and FIG. 13C illustrates the state of dot filling per pixel after driving is corrected in a head-scanning direction.

FIGS. 14A, 14B and 14C are explanatory views of the first embodiment and illustrate formation of dots upon printing using a chip exposed twice through patterns located at a left half and a right half of the reticle according to the first embodiment, in which FIG. 14A illustrates an arranged state of ejection orifice arrays formed in the chip, FIG. 14B illustrates the state of dot filling per pixel, and FIG. 14C illustrates the state of dot filling per pixel after driving is corrected in a head-scanning direction.

DESCRIPTION OF THE EMBODIMENTS

Preferred embodiments of the present invention will now be described in detail in accordance with the accompanying drawings.

Figure 1B:
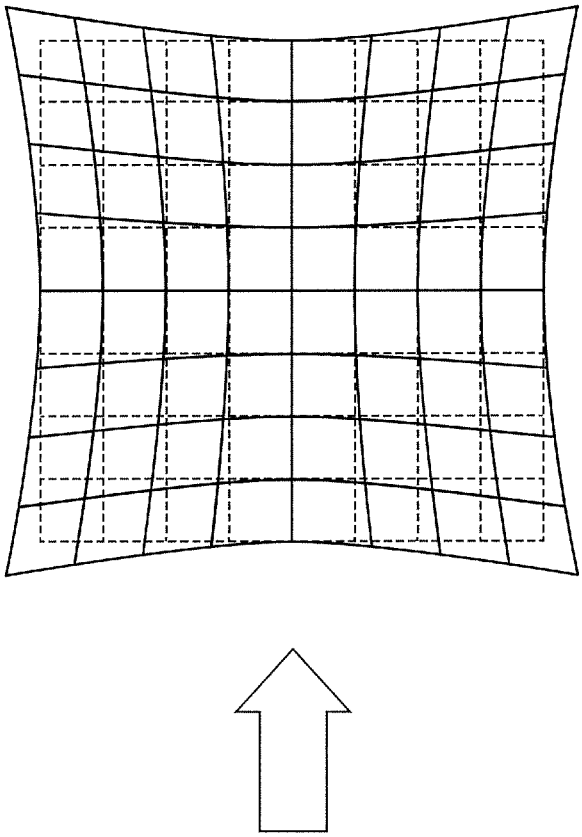
FIG. 1B is an imaginary view illustrating the image that an ideal lattice position is distorted outside with increasing distance from the center of the reticle in the semiconductor exposure apparatus.
Figure 1A:
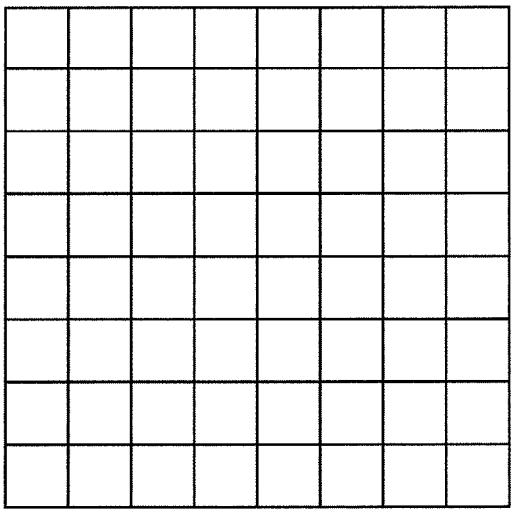
FIG. 1A illustrates ideal lattice patterns provided on the whole surface within a field angle of a reticle in a semiconductor exposure apparatus.

The present inventors have obtained new knowledge that the fundamental optical phenomenon described above with reference to FIGS. 1A and 1B affects a chip and generates the cause of color unevenness upon printing in the case where the liquid ejection head is used for ink jet recording. Specifically, in order to form a chip provided with ejection orifice arrays extending in a long side direction, two chips arranged up and down or left and right with a center of a field angle of a reticle of an exposure apparatus regarded as a center line extending to the same direction as the ejection orifice array are arranged in line symmetry to conduct reduction projection exposure. Thus, between an ejection orifice array close to the center of the reticle and an ejection orifice array distant from the center, a great difference in the distance from the first ejection orifice to the last ejection orifice of the ejection orifice array (hereinafter also referred to as a total pitch) may be caused in some cases under the influence of the above-described optical phenomenon. When an ink jet recording head having a chip which makes such a difference in the total pitch is used to conduct color recording, dot shift occurs in a pixel to be formed, and consequently color unevenness occurs.

On the other hand, the correction can be conducted by the lens system of the exposure apparatus as described in Patent Literature 1. It is however difficult to form a chip in a short period of time with good accuracy when a process time for matching conditions of the lens system for every product, investment in a new lens system and maintainability are considered.

It is an object of the present invention to solve the above-described problems. That is to say, the object of the present invention is to provide a process for producing a chip, by which a batch exposure to plural chips is possible even when distortion from an ideal exposure pattern occurs on an exposure pattern to an object to be exposed, and the field angle of a reticle can be used to the utmost to improve production efficiency.

The present invention relates to a process for producing a chip in which plural ejection orifice arrays are arranged. In the production process according to the present invention, at least one liquid ejection head is fabricated as a rectangular chip in, for example, a chip section of a wafer for cutting out of a chip assigned for one liquid ejection head. After completion of the formation of an intended structure in respective chips, the respective chips are cut out of the wafer and divided into individual chips. That is to say, the wafer is divided, whereby plural chips in which plural ejection orifice arrays are arranged are formed. The liquid ejection head fabricated in each chip has a structure where plural ejection orifice arrays extending in a long side direction of the rectangular chip are arranged in parallel. In addition, the respective chips on the wafer are arranged in a direction parallel to this ejection orifice array (lateral direction), whereby a chip array is formed. Incidentally, plural chip arrays may be arranged repeatedly in a long side direction (vertical direction) of the respective chips, i.e. an extending direction of the ejection orifice array.

An exposure treatment is successively conducted at a predetermined position while relatively moving a reticle of an exposure apparatus which has a field angle corresponding to a region to be subjected to an exposure treatment of the rectangular chip with respect to the wafer along the chip array. The wafer has a substrate formed of, for example, silicon and a photosensitive resin layer formed on the substrate, and the photosensitive resin layer is exposed. The reduction projection exposure is conducted plural times while relatively moving positions of the wafer and the reticle. The relative movement of the reticle to the wafer can be conducted by moving at least one of the reticle and the wafer.

With respect to the relation between the moving direction of the reticle and the exposure treatment, when a direction from the left of the chip array to the right is regarded as a first path and the reverse direction is regarded as a second path whether the exposure to each chip is conducted in the first path, or the exposure to each chip is conducted in the second path is not limited. Whether the exposure is conducted in the first path or in the second path can be selected according to conditions for an exposure operation. The same applies to an exposure operation when each chip array is subjected to the exposure treatment or plural chip arrays are subjected to the exposure treatment at a time in the case where the plural chip arrays are present.

The exposure conducted in the present invention is reduction projection exposure. As the exposure apparatus used in the present invention, a stepper-type exposure apparatus using a reticle in which patterns for exposure are provided in a field angle is suitably used. After ejection orifice array patterns are formed in a photosensitive resin layer, the ejection orifice array patterns are developed, thereby forming ejection orifice arrays in the photosensitive resin layer. Thereafter, the wafer is divided to form plural chips in which plural ejection orifice arrays are arranged.

The reticle used in the present invention has, in a field angle thereof, an exposure pattern in which two overall chip patterns are arranged as exposure patterns necessary for forming plural ejection orifice arrays arranged in parallel in one chip. More specifically, the reticle has a first ejection orifice array pattern corresponding to partial ejection orifice arrays in an arranging direction of ejection orifice arrays in one chip, a second ejection orifice array pattern corresponding to all ejection orifice arrays in another one chip and a third ejection orifice array pattern corresponding to partial ejection orifice arrays in an arranging direction of ejection orifice arrays in a further one chip.

Figures 7A, 7B, 7C:
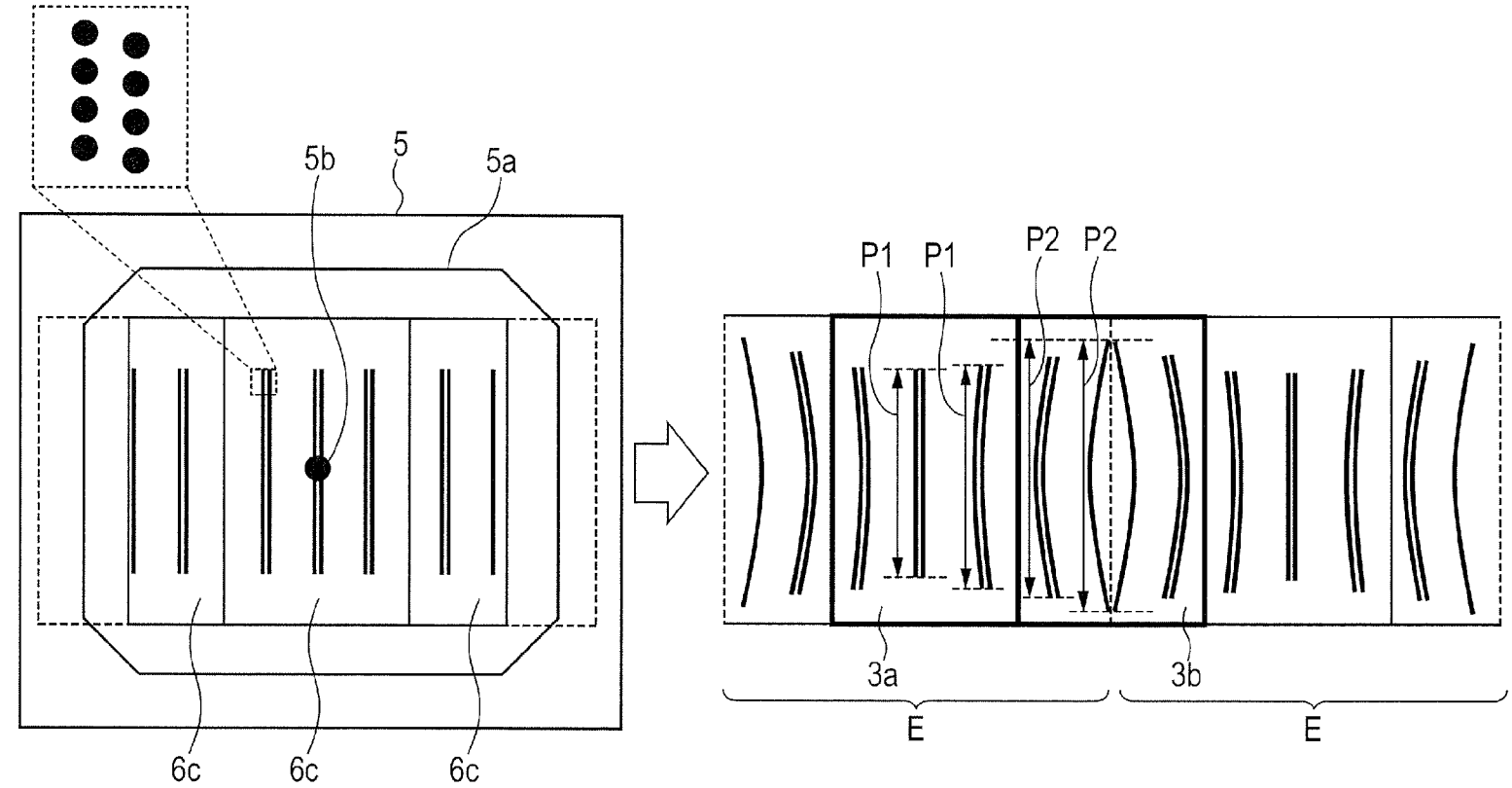
FIGS. 7A, 7B and 7C are explanatory views of a first embodiment of the present invention and illustrate a reticle for exposing two chips adjoining each other of a chip array on a silicon wafer and the chips exposed by the reticle.
Figures 8A, 8B, 8C:
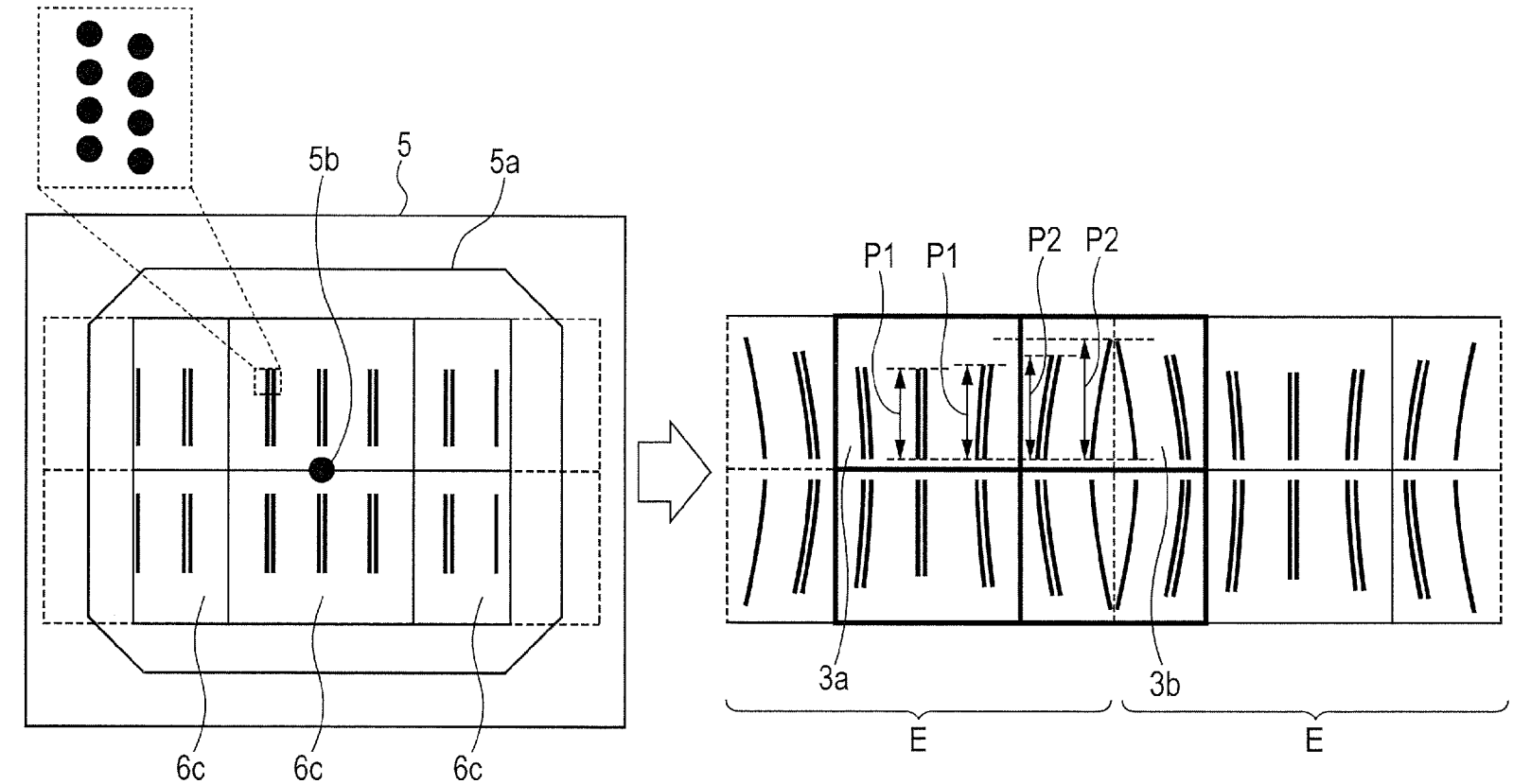
FIGS. 8A, 8B and 8C are explanatory views of the first embodiment of the present invention and illustrate a reticle for exposing four chips adjoining each other of two chip arrays arranged in parallel on a silicon wafer and the chips exposed by the reticle.

The second ejection orifice array pattern (overall chip pattern) is used for conducting exposure to the whole of one chip section in which at least one chip is arranged on a wafer. This chip section may be constituted by one chip as illustrated in FIG. 3A and FIG. 7A or by selecting, as one section, plural chips arranged in series in a vertical direction (long side direction to which an ejection orifice array extends) of plural chip arrays arranged in parallel as illustrated in FIG. 4A and FIG. 8A. The number of chips in the case where one chip section is constituted by plural chips may be suitably selected according to the size of the reticle field angle. In embodiments illustrated in FIG. 4A and FIG. 8A, the chip section is constituted by two chips arranged in series in the vertical direction.

The center of the overall chip pattern used for forming the ejection orifice arrays in one chip is positioned so as to be arranged at a substantial center of the reticle. Additionally, a first side and a second side are present on both sides of the overall chip pattern, and a substantially half chip pattern (first ejection orifice array pattern) on the second side and a substantially half chip pattern (third ejection orifice array pattern) on the first side are respectively laid out on the first side of the overall chip pattern and on the second side of the overall chip pattern, thereby laying out these halves on both sides of the overall chip pattern.

Specifically, two overall chip patterns are provided, and one overall chip pattern thereof is divided into a first half portion and a second half portion in the moving direction of the reticle to obtain a first half chip pattern and a second half chip pattern. The overall chip pattern is then regarded as a center portion in the moving direction of the reticle, and the first half chip pattern and the second half chip pattern are arranged at the first half portion and at the second half portion across the center portion, respectively, to thereby obtain an exposure pattern in the reticle. The exposure is conducted once to form in the photosensitive resin layer a first ejection orifice array pattern corresponding to partial ejection orifice arrays in an arranging direction of ejection orifice arrays in one chip, a second ejection orifice array pattern corresponding to all ejection orifice arrays in another one chip and a third ejection orifice array pattern corresponding to partial ejection orifice arrays in an arranging direction of ejection orifice arrays in a further one chip. An ejection orifice array pattern corresponding to all ejection orifice array in one chip is formed by the first ejection orifice array pattern formed by the one exposure and a third ejection orifice array pattern formed by next one exposure conducted after positions of the wafer and the reticle are relatively moved.

A dividing position (dividing line) between the first half chip pattern and the second half chip pattern in the overall chip pattern may be set so as to satisfy the following requirements (A) and (B) and has no need to be an exact center portion of the overall chip pattern in the moving direction of the reticle. The first ejection orifice array pattern and the third ejection orifice array pattern favorably have an ejection orifice array pattern corresponding to half of all ejection orifice arrays in one chip.

(A) The total pitch difference between plural ejection orifice arrays within one chip in a completed flow path forming member can be controlled within an effective range for preventing occurrence of color unevenness.

(B) Plural ejection orifice arrays in one chip include ejection orifice arrays arranged in line symmetry to a center line in a parallel direction of the ejection orifice arrays.

Incidentally, as examples of the linearly symmetrical arrangement of the ejection orifice arrays of the above condition (B), the following arrangements may be mentioned.

Arrangement 1:

Arrangement in which one ejection orifice array is arranged on the center line, and other plural ejection orifice arrays are arranged in line symmetry to this center line.

Arrangement 2:

Arrangement in which the center line is positioned at a portion where no ejection orifice array is arranged, and plural ejection orifice arrays are arranged in line symmetry to this center line.

The second ejection orifice array pattern has an ejection orifice array pattern corresponding to three or more ejection orifice arrays, and the three or more ejection orifice arrays include ejection orifice arrays for respectively ejecting liquids of different colors, and the ejection orifice arrays are favorably arranged in such a manner that the color arrangement of the liquids becomes line symmetry when viewed from an ejection orifice array located at the center. In addition, an ejection orifice array (C) for ejecting a cyan ink, an ejection orifice array (M) for ejecting a magenta ink and an ejection orifice array (Y) for ejecting a yellow ink are each favorably constituted by two ejection orifice arrays.

Such a constitution that one or more ejection orifice arrays which do not become line symmetry are added in addition to the ejection orifice arrays located at linearly symmetrical positions may also be employed. As an example of Arrangement 1, such ejection orifice arrays that when an ink jet recording head having ejection orifice arrays for three colors of, for example, yellow (Y), magenta (M) and cyan (C) is reciprocatingly moved in a direction intersecting the ejection orifice arrays to conduct bi-directional printing, the arrangement of the ejection orifice arrays is CMYMC may be mentioned.

Figures 14A, 14B, 14C:
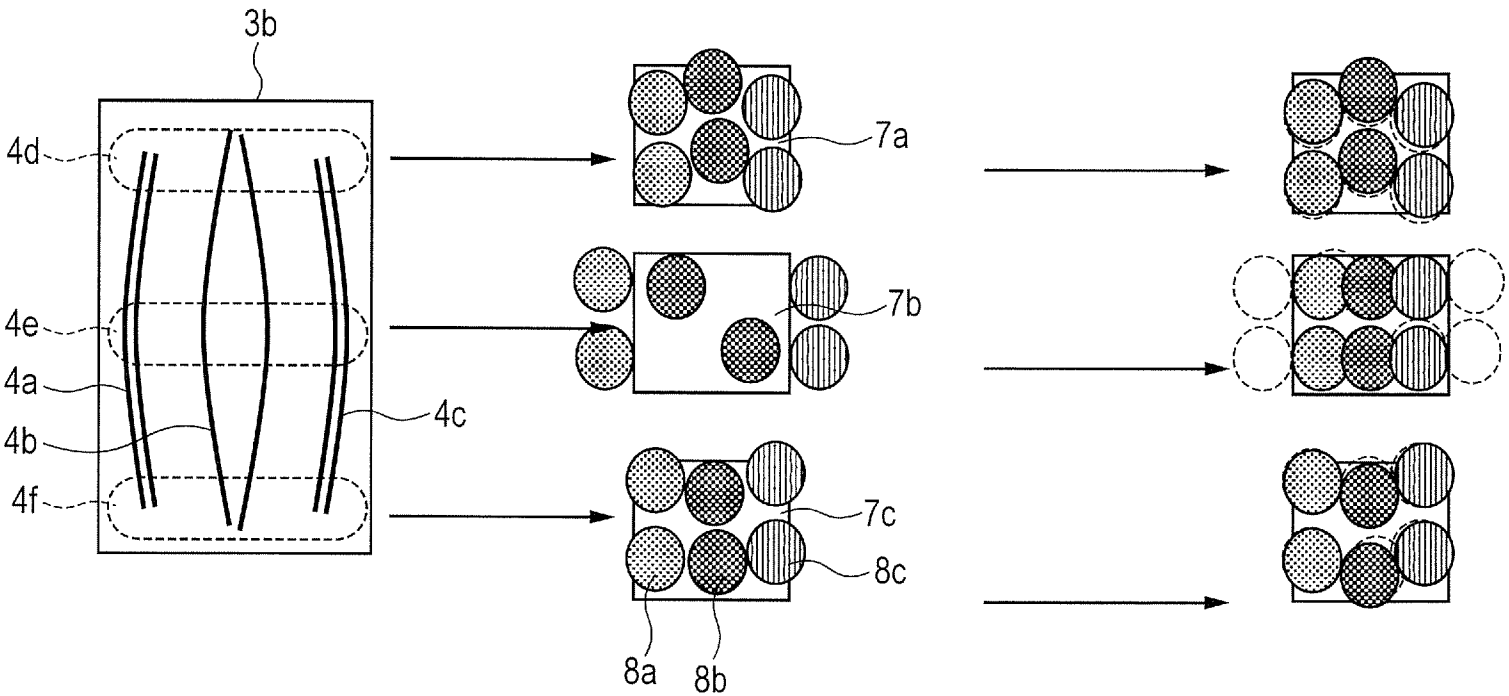

Incidentally, the ejection orifice array taking charge of each color may be of a double array formed of two ejection orifice arrays close to each other in each color as illustrated in FIG. 3A, FIG. 4A, FIG. 7A, FIG. 8A, FIG. 9, FIG. 11A and FIG. 12A. As illustrated in FIG. 12A and FIG. 14A, the center line of line symmetry may be put on a position dividing this double array as illustrated in FIG. 12A and FIG. 14A to lay out the first half chip pattern and the second half chip pattern on the reticle.

The reticle having the exposure pattern of the above-described constitution according to the present invention is used to expose the chip array, whereby the total pitch difference between plural ejection orifice arrays provided within one chip can be effectively reduced. As a result, influence by the structure of a liquid ejection head on the occurrence of color unevenness upon color printing using inks can be reduced.

In addition, even when distortion occurs on an exposure pattern in a part to be exposed distant from the center portion of the reticle, the distance ratio between respective ejection orifice arrays in a lateral direction at an arbitrary position of the respective ejection orifice arrays arranged in line symmetry and in parallel is almost constant according to the distortion. As a result, control for preventing color unevenness in formation of ink dots in a pixel upon printing becomes easy as illustrated in FIGS. 13B and 13C, and FIGS. 14B and 14C.

Arrangement of the reticle of the above-described constitution on a wafer is conducted by aligning a center of the field angle of the reticle with a center of a chip section for a chip to be subjected to the exposure treatment. By this alignment, the overall chip pattern is arranged on one chip section, and the first half chip pattern and the second half chip pattern are arranged on a left half of a chip section neighbor to the right of that chip section and a right half of a chip section neighbor to the left, respectively. Accordingly, one reticle field angle is arranged over neighboring three chip sections. By the exposure treatment under this state, the second half of the chip section neighbor to the right of the chip section with which the center of the reticle field angle has been aligned, that is, of the chip section located ahead of the moving direction of the reticle, is exposed, and the first half of the chip section neighbor to the left, that is, of the chip section located backward of the moving direction of the reticle, is exposed. The chip section with which the center of the reticle field angle has been aligned, and parts of the respective chip sections neighbor to that chip section are exposed at a time in this manner.

Since the left half of the chip section neighbor to the right of the chip section with which the center of the reticle field angle has been aligned has been already subjected to the exposure treatment by the above exposure treatment, the center of the reticle is aligned with respect to a chip section neighbor to the right of this chip section with this chip section skipped upon the next exposure treatment.

One reticle field angle is arranged on non-exposed portions of neighboring three chip sections by doing so, and the second half chip pattern can be arranged on a non-exposed right half of the chip section in which the left half has been already subjected to the exposure treatment. By the exposure treatment under this state, the exposure of the remaining right half of the chip section in which the left half has been already subjected to the exposure treatment can be completed.

As described above, the alignment of the center of the reticle is conducted for every other chip of the chip array, and the exposure treatment is successively conducted repeatedly, whereby the whole chip array can be subjected to the exposure treatment.

In the above description, the description regarding the going direction of the reticle has been made. However, the exposure treatment can be completed by the same operation even when the exposure treatment is conducted by the returning movement.

As the liquid ejection head, there may be mentioned a head having such a structure that a flow path forming member in which plural ejection orifice arrays and a flow path for supplying a liquid to respective ejection orifices constituting an ejection orifice array are formed is arranged on a substrate provided with ejection-energy-generating elements corresponding to the respective ejection orifices. A heat-generating element utilizing heat as ejection energy or a piezo element utilizing vibration may be used as the ejection-energy-generating element.

The steps up to the formation of the ejection orifice arrays in each chip may be selected according to a structure of the intended liquid ejection head and a production process suitable for the structure thereof. As examples of a process for forming the flow path forming member on the substrate, there may be mentioned various publicly known processes, for example, the following processes. For example, the above-described exposure treatment by the reticle may be applied to a coating resin layer for forming a flow path forming member obtained by conducting respective steps in the following respective processes to each chip on a wafer at a time.

(A) A Process Using a Solid Layer which Will Become a Form of the Flow Path Forming Member.

As an example of the process using the solid layer which will become a form of the flow path forming member, Process (I) having the following steps (1) to (6) may be mentioned. Process (I):

(1) A step of providing an ejection-energy-generating element on a substrate.
(2) A step of covering the ejection-energy-generating element on the substrate to form a solid layer as a form occupying a portion which will become a flow path.
(3) A step of forming a coating resin layer formed of a photosensitive material for forming the flow path forming member covering the solid layer.
(4) A step of subjecting the coating resin layer to an exposure treatment and a development treatment to form an ejection orifice array.
(5) A step of providing a piercing aperture which will become a supply port for supplying a liquid to the flow path from a back side of the substrate.
(6) A step of removing the solid layer on the substrate using the piercing aperture to form the flow path.

Incidentally, the order of the steps (4) to (6) may be changed.

The photosensitive material for forming the coating resin layer (photosensitive resin layer) may be selected according to the structure of a liquid ejection head, which is an object of production, and a production process thereof. As an example, a positive photosensitive resin such as poly(methyl isopropenyl ketone) is used as a material for forming the solid layer, and exposure and development are conducted according to information, whereby a solid layer of a desired form can be arranged on the substrate. In addition, a negative photosensitive resin composition may be used as a material for forming the coating resin layer. The coating resin layer becomes an ejection orifice forming member and is formed by, for example, an epoxy resin, a photo-induced cationic polymerization initiator, a sensitizer and methyl isobutyl ketone.

(B) A Process of Forming an Orifice Plate Utilizing a Filling Layer (Sacrifice Layer) after Formation of a Flow Path Wall.

As an example of the process of forming the orifice plate utilizing the filling layer (sacrifice layer) after formation of the flow path wall, Process (II) having the following steps (1) to (7) may be mentioned. Process (II):

(1) A step of providing an ejection-energy-generating element on a substrate.

(2) A step of providing a flow path wall on the substrate on which the ejection-energy-generating element has been provided.

(3) A step of filling a filling material (sacrifice layer) in a portion which is surrounded by the flow path wall and will become a flow path.

(4) A step of forming a layer for an orifice plate with a photosensitive material on a surface formed by the flow path wall and the filling material (sacrifice layer).

(5) A step of subjecting the layer for the orifice plate to an exposure treatment and a development treatment to form an ejection orifice array.

(6) A step of providing a piercing aperture which will become a supply port for supplying a liquid to the flow path from a back side of the substrate.

(7) A step of removing the filling material (sacrifice layer) on the substrate using the piercing aperture to form the flow path.

In the above-described process, the flow path forming member is constituted by the flow path wall and the orifice plate (ejection orifice plate).

These processes are disclosed in, for example, Japanese Patent Application Laid-Open No. 2005-205916. According to the process described in this publication, after the flow path wall is covered with the filling material (sacrifice layer) to conduct a filling step, an upper surface thereof is then flattened to expose an upper surface of the flaw path wall, and the orifice plate (plate for forming an ejection orifice) is then formed. As described above, various steps may be added as needed.

The photosensitive material for forming the coating resin layer may be selected according to the structure of a liquid ejection head, which is an object of production, and a production process thereof.

The liquid ejection head may be any head so far as the head has such a structure that a chip array capable of being divided from the wafer can be formed, and exposure and development treatments for forming an ejection orifice array can be conducted to each chip on the wafer, and the production process according to the present invention can be applied to liquid ejection heads of various structures.

Embodiments of the present invention will hereinafter be described with reference to the drawings.

Figure 9:
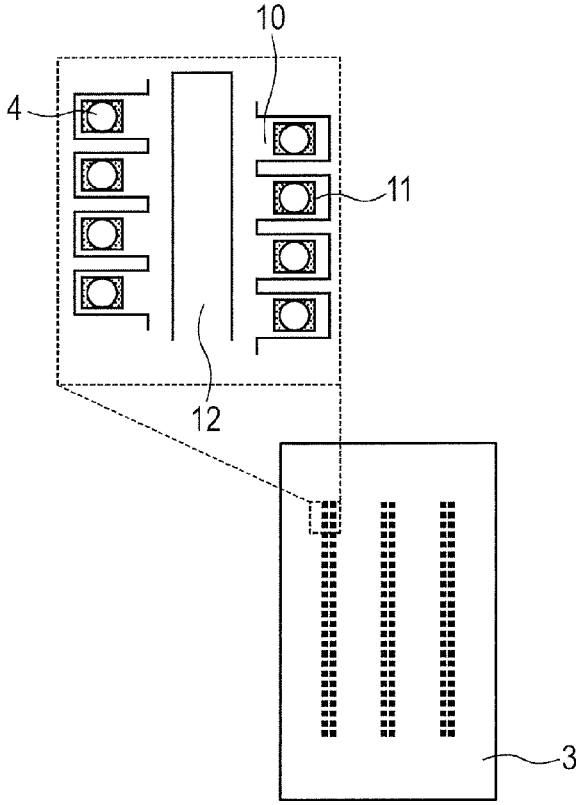
FIG. 9 PRIOR ART
FIG. 9 is an explanatory view of a yet still further conventional embodiment and illustrates the external form of a typical chip and the structure thereof.

A liquid ejection head of an ink jet recording apparatus to which this embodiment can be applied is first described with reference to FIGS. 9 and 10.

Figure 10:
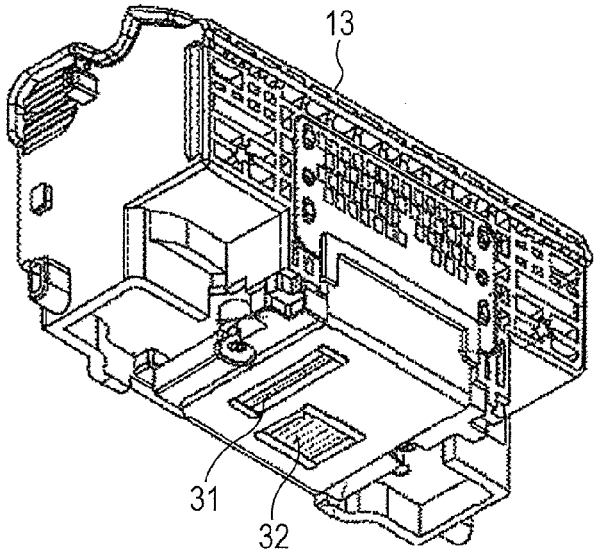
FIG. 10 PRIOR ART
FIG. 10 is an explanatory view of a yet still further conventional embodiment and illustrates the external form of a typical head and the structure thereof.

The liquid ejection head produced by this embodiment is, for example, such a head as illustrated in FIG. 10. FIG. 10 illustrates a head 13 in which two different chips 31 and 32 are installed. This embodiment is not limited to the constitution illustrated in this drawing and may include a head in which a single chip or three or more chips are installed. FIG. 9 illustrates the constitution of a typical chip of the chips installed in the head illustrated in FIG. 10. Heat-generating elements utilized for ejecting an ink are arranged at predetermined intervals in this chip 3, and a supply port 12 that passes through a substrate from a back side of the substrate for supplying an ink is opened between two arrays of the heat-generating elements 11. In addition, ejection orifices 4 opening above the respective heat-generating elements 11 and individual ink flow paths communicating with the respective ejection orifices 4 from the supply port 12 are formed on the chip 13 by a cured film of a photosensitive resin. This liquid ejection head is arranged in such a manner that a surface on which the ejection orifices are formed faces a recording surface of a recording medium. In this liquid ejection head, a pressure generated by the heat-generating element is applied to an ink filled in the flow path through the ink supply port to eject an ink droplet from the ejection orifice, and this ink droplet is applied to a recording medium, thereby conducting recording. Incidentally, FIG. 9 illustrates the case where there are three ejection orifice arrays. However, the present invention is not limited to the constitution of this drawing so far as the number of arrays is plural (2 or more).

An example of a process for producing the liquid ejection head will hereinafter be described.

Figure 2:
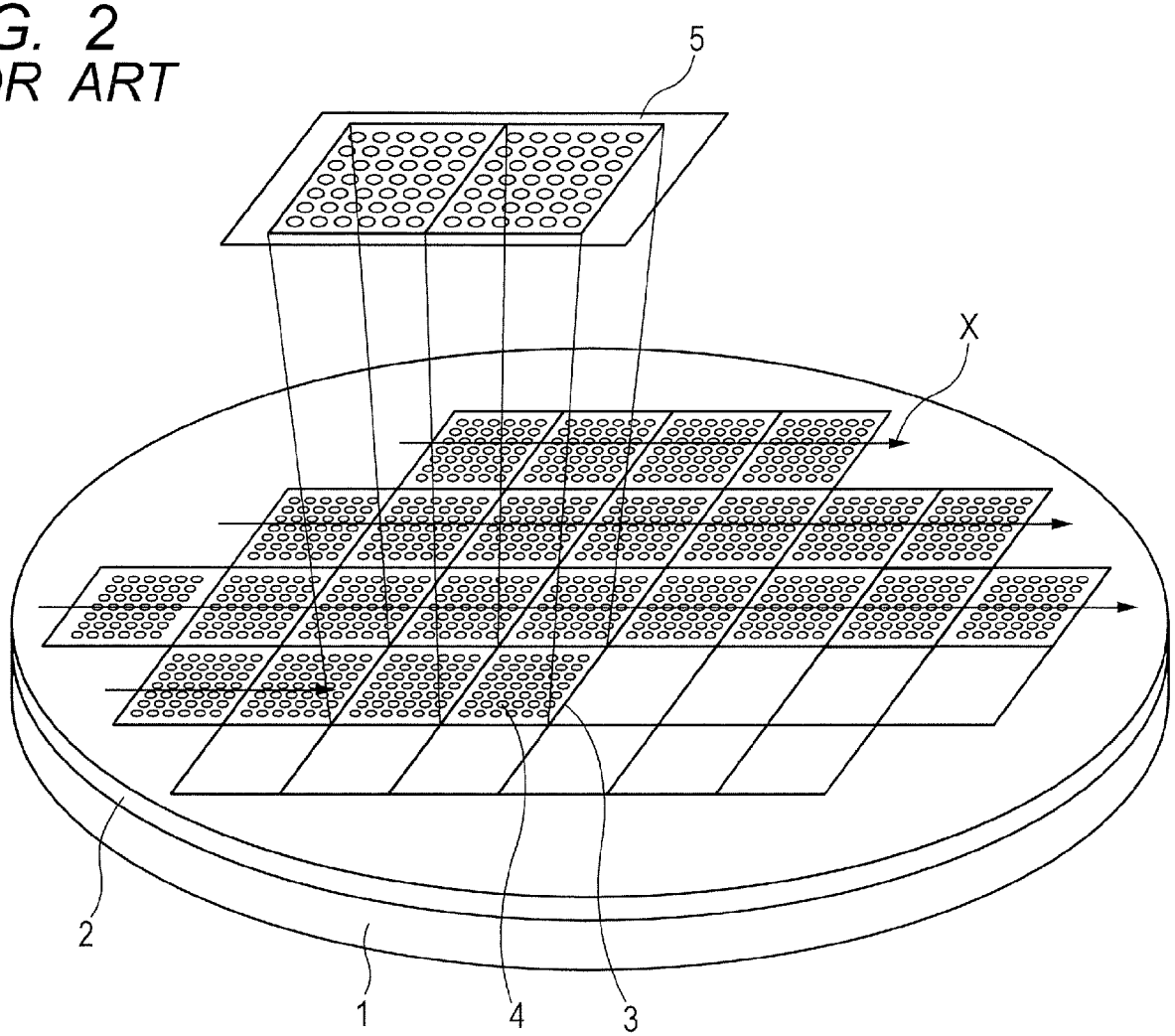
FIG. 2 PRIOR ART
FIG. 2 is an explanatory view of a conventional embodiment and illustrates the state that exposure is conducted to chips on a silicon wafer by means of a reticle.

After a flow path (not illustrated) and the like are formed in each section which will become a chip 3 of a silicon wafer as a wafer 1 for cutting out of a chip in which a heat-generating element (not illustrated) has been arranged, a negative photosensitive resin film 2 is formed as illustrated in FIG. 2, and an exposure treatment is successively conducted to a portion of the photosensitive resin film 2 located on the heat-generating element by moving a reticle 5 having an exposure pattern for forming an ejection orifice array in a direction of the arrow X. After the exposure treatment to respective chips is completed, a development treatment is conducted at a time on the wafer to obtain a flow path forming member which is formed of a cured film of the photosensitive resin and in which an ejection orifice array is arranged at a predetermined position in the respective chips 3.

A method such as a spin coating method, a roll coating method or a slit coating method may be used for forming the photosensitive resin film. Incidentally, the above-described mode of providing the pattern which will become the form of the flow path may also be used. Both the method of providing the pattern which will become the form and the method making no use of the form are included in the present invention.

In addition, an ink repellent layer having negative photosensitivity may be formed on the photosensitive resin layer as needed. The ink repellent layer can be formed by a coating method such as a spin coating method, a roll coating method or a slit coating method. However, since the ink repellent layer is formed on an uncured negative photosensitive resin film in this embodiment, both layers are favorably not compatible with each other more than necessary.

A light condensation type exposure apparatus may be suitably used for the exposure treatment by the reticle, and the reduction rate of the light condensation type exposure apparatus may be controlled to, for example, about ½ to 1/10.

The present inventors have found that a new problem of occurrence of color unevenness upon printing using an ink jet recording head obtained by using the exposure apparatus using such an optical system is caused. This problem is described taking a case where chips each having three ejection orifice arrays constitute a chip array as an example. FIGS. 3A, 3B and 3C illustrate a case where neighboring two chip sections corresponding to two chips are provided within a field angle 5*a* of a reticle 5 for arranging first to third ejection orifice arrays 4*a*, 4*b* and 4*c* in parallel in each of chips 3*a* and 3*b* neighboring left and right, and an ejection orifice array pattern 6*a* for conducting a batch exposure to these chip sections is used. FIG. 3A includes an enlarged view (FIG. 3C)

of an ejection orifice pattern. Incidentally, an enlarged view of an ejection orifice pattern is likewise added to with respect to FIGS. 4A, 7A, 8A, 11A and 12A. When exposure is conducted by using this reticle 5, a difference is caused between an ejection orifice array close to the center of the reticle 5 and an ejection orifice array distant from the center in a total pitch from the first ejection orifice to the last ejection orifice of the ejection orifice array in the two chips 3*a*, 3*b* after the exposure as illustrated in FIG. 3B. Even in a direction perpendicular to the ejection orifice array, dislocation D in an outward direction to the center 5*b* of the reticle occurs on an ejection orifice closer to the end of the ejection orifice array.

FIGS. 4A, 4B and 4C illustrate a case where one chip section is set for two chips arranged in series in a vertical direction in two chip arrays. In FIG. 4B, one chip section is constituted corresponding to a combination of a chip 3*c* and a chip 3*d*, another chip section is constituted corresponding to a combination of a chip 3*e* and a chip 3*f*. The reticle 5 has an ejection orifice array pattern 6*b* for four chips to be laid out on the two chip sections within one reticle field angle 5*a*. Even upon an exposure operation using the reticle 5 illustrated in FIG. 4A, the above-described technical problem occurs in the four chips 3*c* to 3*f* after the exposure like the case illustrated in FIG. 3B.

Figure 5A:
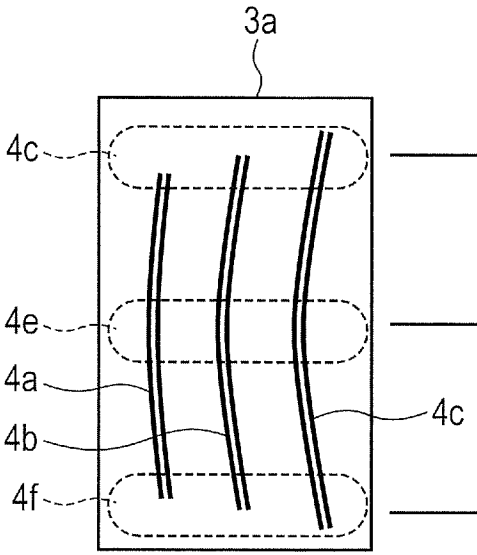
FIG. 5A PRIOR ART
Figure 5B:
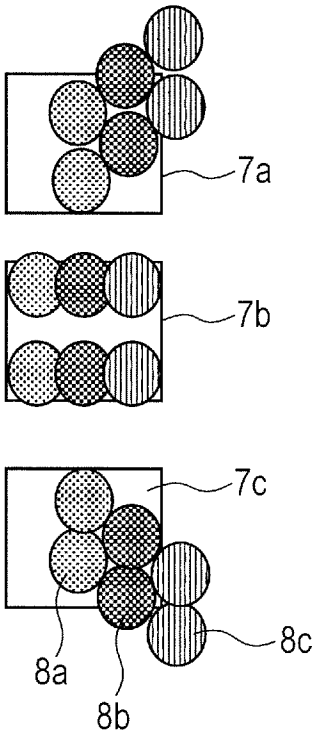
FIG. 5B PRIOR ART

A chip 3*a* illustrated in FIG. 5A is a chip which is exposed through a left reticle pattern illustrated in FIG. 3A and has first to third ejection orifice arrays 4*a* to 4*c*. Incidentally, FIG. 3B is a plan view in which the ejection orifice arrays are illustrated upward in a vertical direction in the drawing. On the other hand, FIG. 5A illustrates a state actually installed in a head. That is to say, FIG. 5A is a bottom plan view in which the ejection orifice arrays are illustrated downward in a vertical direction in the drawing (therefore, a drawing turned by 180° along a direction of the ejection orifice array). When such a chip is driven by what is called serial printing (such a printing method that a head is scanned in a direction perpendicular to the ejection orifice array) without controlling anything, dislocation of the ejection orifice array is reflected on the printing as it is, so that a problem such as dot shift with respect to an original pixel occurs as illustrated in FIG. 5B illustrating the state of dot filling per pixel. For example, image unevenness by the following phenomenon occurs between the first and last ejection orifice sides 4*d* and 4*f* of the respective ejection orifice arrays, and the central ejection orifice side 4*e* of the respective ejection orifice arrays upon formation of dots by the first to third ejection orifice arrays 4*a*, 4*b* and 4*c*.

With respect to the ejection orifices of ejection orifice array ends 4*d* and 4*f*, dots 8*a*, 8*b* and 8*c* printed by the first to third ejection orifice arrays shift in both ejection orifice array direction and horizontal direction (head-scanning direction) with respect to predetermined pixels 7*a* and 7*c* (the dots shift diagonally to the upper right in the first-side ejection orifices of the ejection orifice arrays and to the lower left in the last-side ejection orifices of the ejection orifice arrays.)

The pixels 7*a* and 7*c* in which the dot shift has occurred are different in dot filling within a pixel from the pixel 7*b* corresponding to the ejection orifices located at the center 4*e* of the ejection orifice arrays in which no dot shift occurs.

Figure 5C:
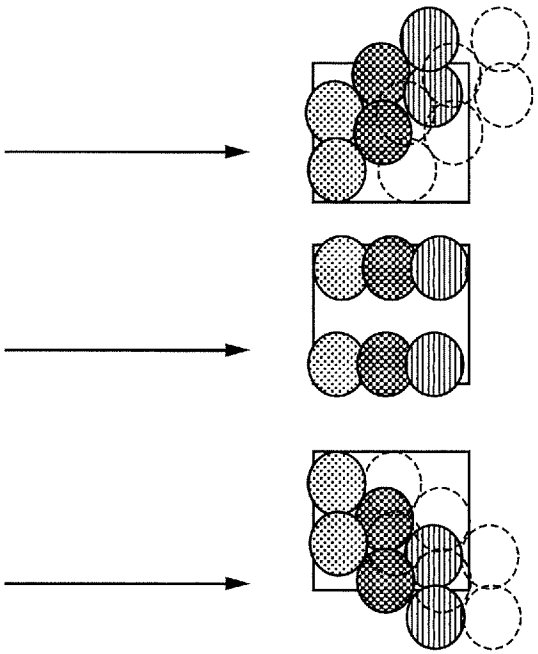
FIG. 5C PRIOR ART

Incidentally, with respect to the shift in the direction perpendicular to the ejection orifice array direction (head-scanning direction), the dots can be arranged at positions close to the predetermined pixel by correcting drive timing as illustrated in FIG. 5C. Alternatively, the shift can be made inconspicuous by dispersing the drive timing at random. However, since the dot shift in the ejection orifice array direction due to the total pitch difference inevitably occurs in the predetermined pixel, the image unevenness has been unable to be completely eliminated.

First Embodiment:

The first embodiment of the present invention is illustrated in FIGS. 7A, 7B and 7C. The steps before the exposure treatment for forming the ejection orifice arrays in each chip are the same as the case described above with reference to FIG. 2 and FIGS. 3A, 3B and 3C. That is to say, in this embodiment, the center of an overall chip pattern 6*c* used for forming one chip having three arrays of first to third ejection orifice arrays is positioned so as to locate at a substantial center with respect to the center 5*b* of a reticle as illustrated in FIG. 7A. Incidentally, a first side and a second side are present on both sides of the overall chip pattern 6*c*, and a substantially half chip pattern on the second side and a substantially half chip pattern on the first side are respectively laid out on the first side of the overall chip pattern 6*c* and on the second side thereof, thereby laying out these halves on both sides of the overall chip pattern 6*c*. In FIG. 7A, a direction from the left thereof to the right is a moving direction of the reticle along a chip array, a forward half chip pattern in this moving direction is a first half chip pattern, and a backward half chip pattern is a second half chip pattern.

Figure 6:
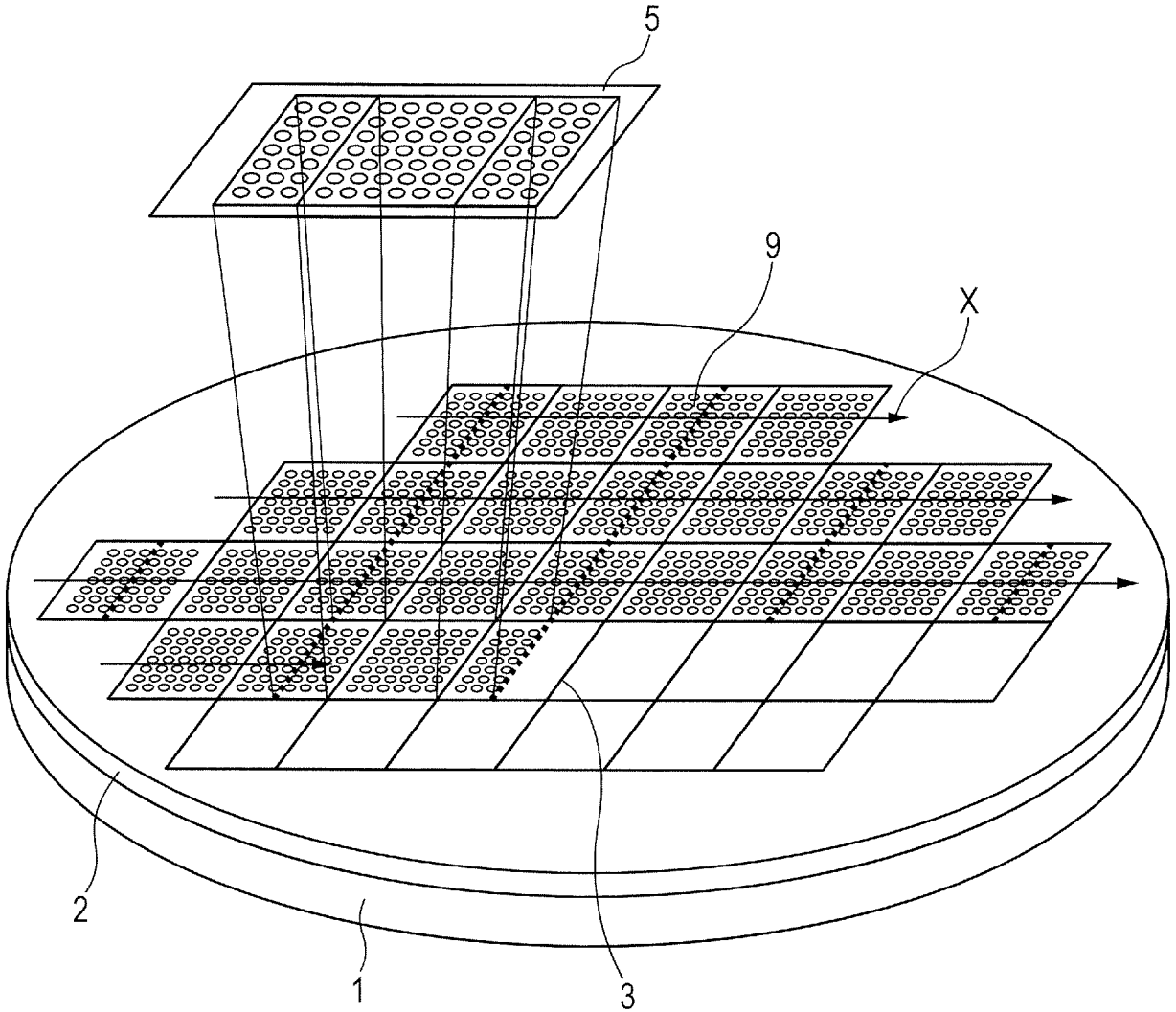
FIG. 6 is an explanatory view of an embodiment of the present invention and illustrates the state that exposure is conducted to chips on a silicon wafer by means of a reticle.

When exposure is conducted by using such a reticle 5 in such a manner that a chip pattern laid out at a center fits the external form of a chip on a silicon wafer 1 as illustrated in FIG. 6, the chip is exposed through the chip pattern of the reticle 5, and at the same time substantial halves of two chips on both sides thereof are exposed. From the next exposure, the alignment of the center of the reticle is conducted for every other chip of the chip array so as not to overlap with a portion exposed once to successively conduct the exposure. As a result, the remaining halves of the both sides are exposed eventually. FIG. 6 illustrates the state where portions sectioned by exposure joint portions 9 are successively exposed while shifting the reticle by a distance corresponding to two chips in a horizontal direction indicated by the arrow X in FIG. 6. With respect to the chips which are exposed half by half, an overlapping region is favorably provided between a portion first exposed and a portion second exposed taking an exposure alignment error into consideration though not illustrated in FIG. 6. The overlapping region does favorably not overlap with an ejection orifice.

As described in FIG. 7B, a chip 3*a* of the first kind and a chip 3*b* of the second kind can be produced by adopting such a production process. In each chip, the difference in the total pitch P1 or P2 between the respective ejection orifice arrays becomes small compared with the total pitch difference of a conventional chip, so that the image unevenness can be greatly relieved. The details thereof are as follows.

Figures 13A, 13B, 13C:
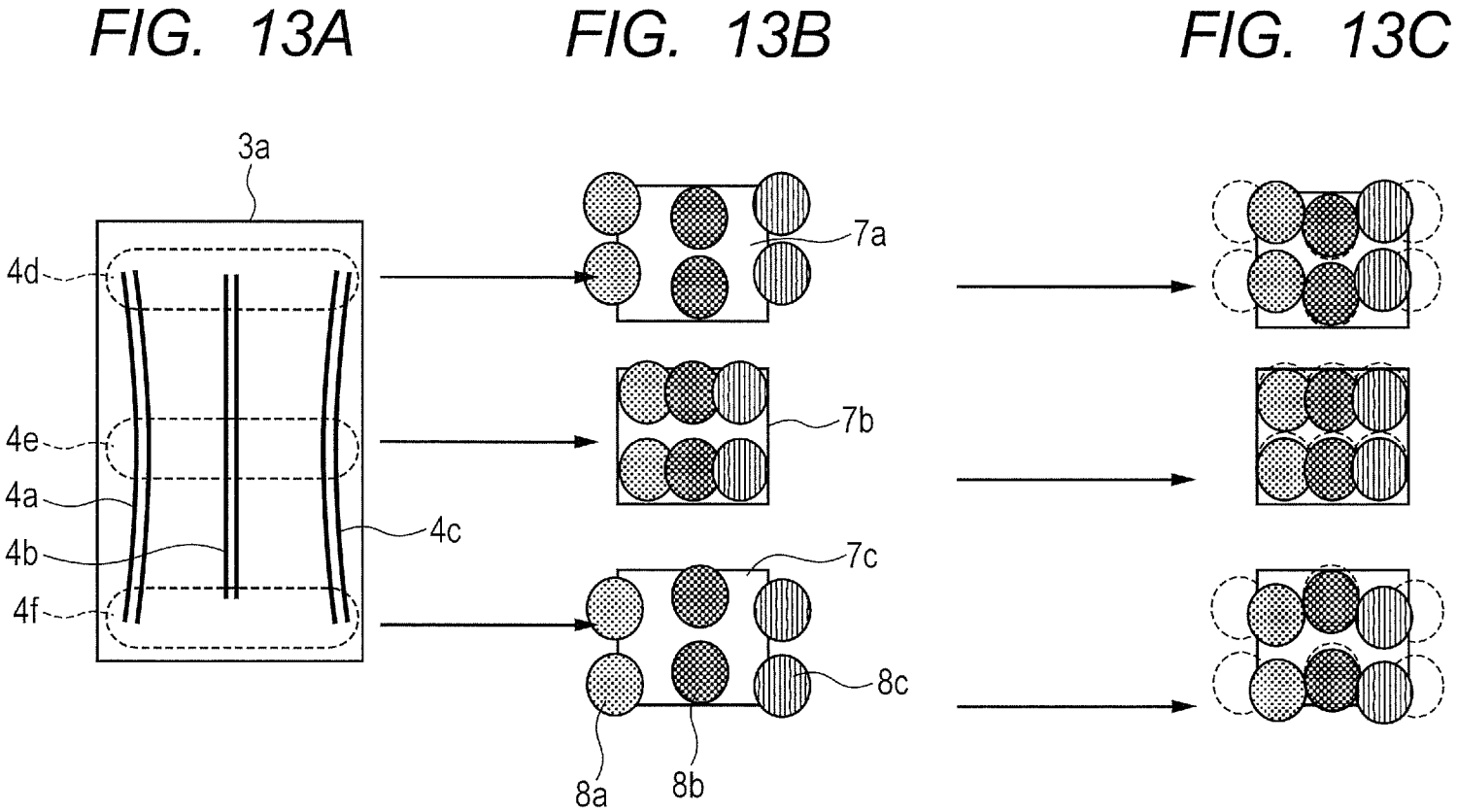

The chip 3*a* illustrated in FIG. 13A is a chip exposed through the reticle pattern located at the center of the reticle illustrated in FIG. 7A. The chip 3*b* illustrated in FIG. 14A is a chip completed by conducting exposure twice in total through the reticle pattern located on the right side or the left side illustrated in FIG. 7A. FIG. 7B is a view in which the ejection orifice arrays are illustrated upward in a vertical direction in the drawing. On the other hand, FIG. 13A and FIG. 14A illustrate a state of being actually installed in a head, that is, views in which the ejection orifice arrays are illustrated downward in a vertical direction in the drawings. When such a chip as illustrated in FIG. 13A or FIG. 14A is driven by what is called serial printing (such a printing method that a head is scanned in a direction perpendicular to the ejection orifice array) without controlling anything, dislocation of the ejection orifice array is reflected on the printing as it is.

According to this embodiment, however, the difference in the total pitch P1 or P2 between the respective ejection orifice arrays is small as described above, so that such great dot shift in the ejection orifice array direction as illustrated in FIG. 5B vanishes. In addition, color unevenness can be made inconspicuous by, for example, correction of drive timing as illustrated in FIG. 13C and FIG. 14C.

Incidentally, when the number of ejection orifice arrays is odd in the chip 3*b* of the second kind illustrated in FIG. 14A, the dot shift in a direction perpendicular to the ejection orifice array of the positions of the respective ejection orifices in the ejection orifice array 4*e* located at the center (scanning direction) may become great in some cases compared with a conventional process. With respect to the shift in the head-scanning direction, droplets can be arranged at positions close to the predetermined pixel by correcting drive timing as described above. Alternatively, color unevenness can be made inconspicuous by dispersing the drive timing at random as illustrated in FIG. 14C. In the exposure by the reticle laid out in this manner, the region corresponding to substantially two chips come to be exposed, so that it goes without saying that the time of the exposure step does not become long compared with a conventional process.

On the other hand, in a case where a chip section is constituted by two chips arranged in series in a vertical direction as illustrated in FIG. 8B and two chip sections are exposed by one reticle, that is, four chips neighboring up and down and left and right are divided, the same effect as that in the case described with reference to FIGS. 7A, 7B and 7C can be obtained. In other words, the difference in the total pitch P is great in the conventional layout of the reticle illustrated in FIG. 4A. However, the difference in the total pitch P1 or P2 becomes small by adopting the constitution illustrated in FIG. 8A, and image unevenness can be effectively reduced.

Figures 11A, 11B, 11C:
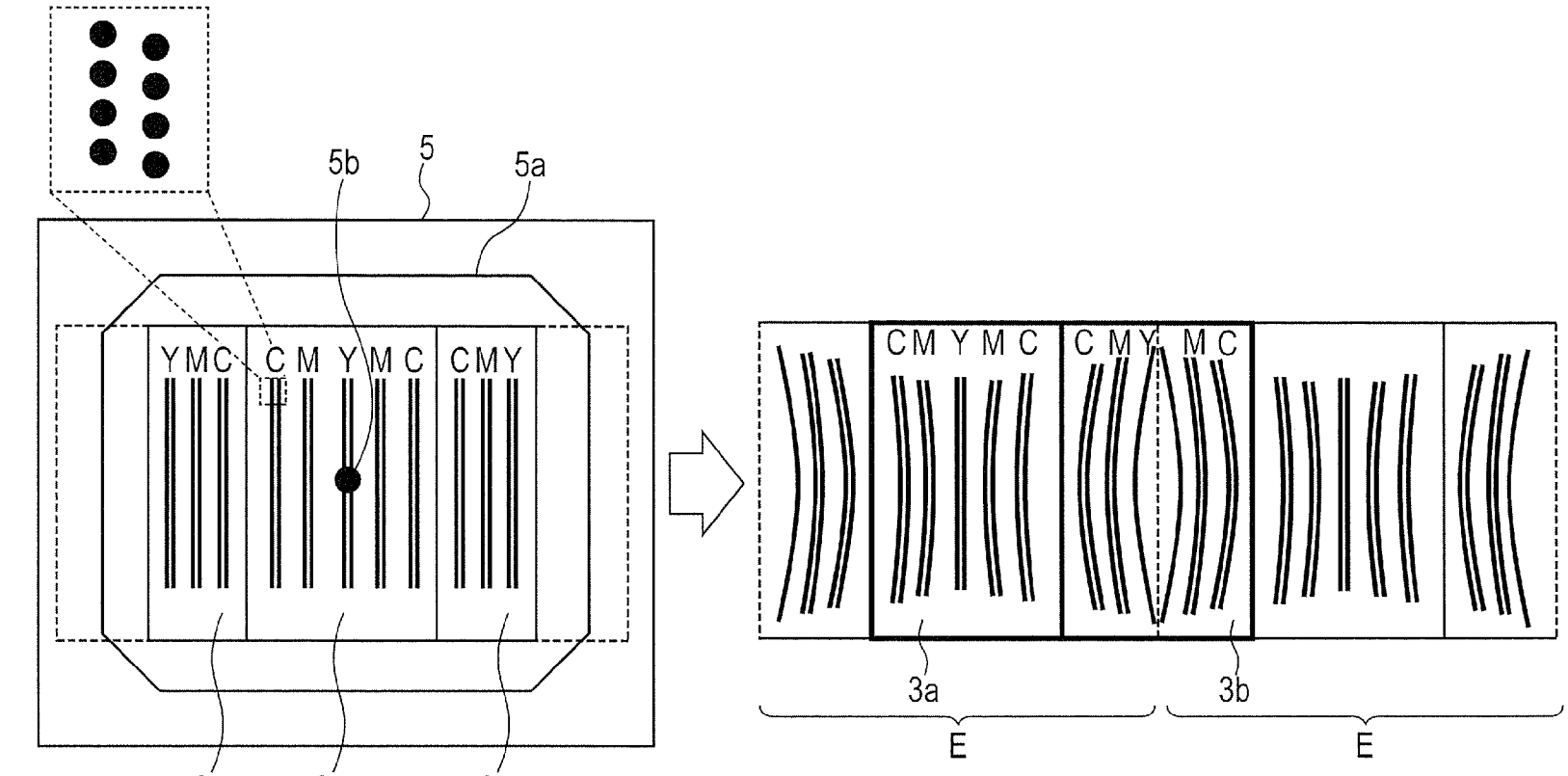
FIGS. 11A, 11B and 11C are explanatory views of a second embodiment of the present invention and illustrate a reticle for exposing chips on a silicon wafer and the chips exposed by the reticle.

Second Embodiment:

The second embodiment relating to a bi-directional printing compatible chip usable in color printing is illustrated in FIGS. 11A, 11B and 11C. In this embodiment, features different from the first embodiment are described. In the second embodiment, a chip has five ejection orifice arrays. Ejection orifice arrays for cyan (C), magenta (M) and yellow (Y) that are principal colors were arranged in line symmetry to yellow (Y) as an axis in the order of C, M, Y, M and C in an arranging direction of a chip array so as not to cause color order unevenness when bi-directional printing is conducted. When two arrays for cyan or two arrays for magenta are viewed as a single color as a result of the case of such a constitution, a difference in the total pitch in the respective arrays is almost 0. With respect to the shift in the head-scanning direction, these arrays are arranged in line symmetry to a reticle center 5*b*, so that there is also a merit that image processing of a single color is easy to be conducted. Even in this embodiment, such a mode that four chips neighboring up and down and left and right are divided as described in the first embodiment is applied, whereby the same effect as the first embodiment can be achieved.

Third Embodiment:

The third embodiment relating to a bi-directional printing compatible chip usable in color printing is illustrated in FIGS. 12A, 12B and 12C. In this embodiment, features different from the first embodiment are described. In the third embodiment, a chip has six or more ejection orifice arrays. Ejection orifice arrays for cyan (C), magenta (M) and yellow (Y) that are principal colors were arranged in line symmetry to yellow (Y) as an axis in the order of C, M, Y, M and C in an arranging direction of a chip array so as not to cause color order unevenness when bi-directional printing is conducted. In this embodiment, for black (Pk) which is not a principal color (relatively small in shot-in ink quality upon photo-printing and hard to affect the color order unevenness), it is not bi-directional printing compatible.

It is necessary for measures against color unevenness to give priority to the principal colors great in shot-in ink quality and easy to affect the color unevenness. That is, it is necessary to decrease the total pitch difference of the principal colors with priority. Accordingly, the ejection orifice arrays are favorably arranged in such a manner that the reticle center 5*b* coincides with a substantial center of the Y array to decrease the total pitch difference of the arrays for cyan, magenta and yellow which are principal colors. In addition, when two arrays for cyan or two arrays for magenta are viewed as a single color as a result of doing so, a difference in the total pitch in the respective arrays is almost 0. With respect to the shift in the head-scanning direction, these arrays are arranged in line symmetry to the reticle center, so that there is also a merit that image processing of a single color is easy to be conducted.

Gray (Gy) has also come to become a principal color in addition to cyan (C), magenta (M) and yellow (Y) upon formation of a higher-quality photo image in recent years. That is to say, this embodiment also includes bi-directional printing compatible chips in which Gy is also arranged in line symmetry to yellow as an axis in the order of C, M, Gy, Y, Gy, M and C. Even in this embodiment, such a mode that four chips neighboring up and down and left and right are divided as described in the first embodiment is applied, whereby the same effect as the first embodiment can be achieved.

The chips formed according to the present invention are as follows as illustrated in FIG. 7B and FIG. 8B. One is a chip in which plural ejection orifice arrays are arranged, wherein the length of a central ejection orifice array among ejection orifice arrays constituting the plural ejection orifice arrays is longest, and the ejection orifice arrays are arranged in descending order of the length of the ejection orifice array from the central ejection orifice array toward ejection orifice arrays on both sides. Another one is a chip in which plural ejection orifice arrays are arranged, wherein the length of a central ejection orifice array among ejection orifice arrays constituting the plural ejection orifice arrays is shortest, and the ejection orifice arrays are arranged in ascending order of the length of the ejection orifice array from the central ejection orifice array toward ejection orifice arrays on both sides.

These plural ejection orifice arrays include ejection orifice arrays for respectively ejecting liquids of different colors, and the ejection orifice arrays are favorably arranged in such a manner that the color arrangement of the liquids becomes line symmetry when viewed from a central ejection orifice array.

According to the above-described constitution of the present invention, a batch exposure is conducted to plural chips by devising an exposure pattern provided within a reticle field angle and its position to an object to be exposed, whereby the time of the exposure step can be shortened, and the exposure treatment can be conducted with good efficiency. In addition, the total pitch difference between plural ejection orifice arrays provided in one chip can be controlled within a tolerable range necessary for effectively preventing occurrence of color unevenness.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-003477, filed Jan. 11, 2013, which is hereby incorporated by reference herein in its entirety.

What is claimed is:

1. A process for producing a chip in which plural ejection orifice arrays are arranged, the process comprising the steps of:

conducting reduction projection exposure plural times to a wafer having a substrate and a photosensitive resin layer formed on the substrate while relatively moving positions of the wafer and a reticle to form ejection orifice array patterns in the photosensitive resin layer, developing the ejection orifice array patterns to form ejection orifice arrays in the photosensitive resin layer, and dividing the wafer having the photosensitive resin layer in which the ejection orifice arrays have been formed to form plural chips in which the plural ejection orifice arrays are arranged, wherein the reduction projection exposure is conducted once to form in the photosensitive resin layer a first ejection orifice array pattern corresponding to partial ejection orifice arrays in an arranging direction of ejection orifice arrays in one chip, a second ejection orifice array pattern corresponding to all ejection orifice arrays in another one chip and a third ejection orifice array pattern corresponding to partial ejection orifice arrays in an arranging direction of ejection orifice arrays in a further one chip.

2. The process according to claim 1, wherein an ejection orifice array pattern corresponding to all ejection orifice arrays in one chip is formed by the first ejection orifice array pattern formed by one exposure and a third ejection orifice array pattern formed by next one exposure conducted after positions of the wafer and the reticle are relatively moved.

3. The process according to claim 1, wherein the first ejection orifice array pattern and the third ejection orifice array pattern have an ejection orifice array pattern corresponding to half of all ejection orifice arrays in one chip.

4. The process according to claim 1, wherein the second ejection orifice array pattern has an ejection orifice array pattern corresponding to three or more ejection orifice arrays, and the three or more ejection orifice arrays include ejection orifice arrays for respectively ejecting liquids of different colors, and the ejection orifice arrays are arranged in such a manner that the color arrangement of the liquids becomes line symmetry when viewed from an ejection orifice array located at the center.

5. The process according to claim 4, wherein the three or more ejection orifice arrays have an ejection orifice array (C) for ejecting a cyan ink, an ejection orifice array (M) for ejecting a magenta ink and an ejection orifice array (Y) for ejecting a yellow ink, and the chip is constituted in such a manner that the ejection orifice arrays are arranged in the order of CMYMC.

6. The process according to claim 5, wherein the ejection orifice array (C) for ejecting the cyan ink, the ejection orifice array (M) for ejecting the magenta ink and the ejection orifice array (Y) for ejecting the yellow ink are each constituted by two ejection orifice arrays.

* * * * *